US008333334B1

(12) United States Patent
Gefert

(10) Patent No.: US 8,333,334 B1
(45) Date of Patent: Dec. 18, 2012

(54) ELECTRO-SPRAY COATING HEAD APPLICATOR

(76) Inventor: Thad Gefert, Columbiana, OH (US)

( * ) Notice: Subject to any disclaimer, the term of this patent is extended or adjusted under 35 U.S.C. 154(b) by 239 days.

(21) Appl. No.: 12/924,053

(22) Filed: Sep. 20, 2010

(51) Int. Cl.
*B05B 3/10* (2006.01)

(52) U.S. Cl. ..... 239/223; 239/224; 239/293; 239/567; 239/700; 239/723

(58) Field of Classification Search ..... 239/700, 239/703, 293, 223, 592, 224, 246, 248, 249, 239/494, 496, 523, 567, 568
See application file for complete search history.

(56) References Cited

U.S. PATENT DOCUMENTS

| | | | | |
|---|---|---|---|---|
| 2,655,408 | A * | 10/1953 | Williams | 239/592 |
| 4,376,135 | A * | 3/1983 | Patel et al. | 427/484 |
| 5,326,598 | A | 7/1994 | Seaver et al. | |
| 5,353,995 | A | 10/1994 | Chabert | |
| 5,368,237 | A | 11/1994 | Fulkerson | |
| 5,632,448 | A | 5/1997 | Alexander et al. | |
| 5,865,380 | A | 2/1999 | Kazama et al. | |
| 5,922,131 | A | 7/1999 | Haas | |
| 6,230,993 | B1 * | 5/2001 | Austin et al. | 239/700 |

* cited by examiner

*Primary Examiner* — Jason Boeckmann
(74) *Attorney, Agent, or Firm* — Harpman & Harpman

(57) ABSTRACT

A rotary spray head for atomizing and dispersing fluidized coating material within a bearing stream. The rotary spray head has a plurality of elongated contoured material dispersing portals positioned to define multiple overlapping product stream flow across a diffuser surface imparting translateral product stream homogenation and adaptive proportional edge shear for an improved coating dispersal pattern.

4 Claims, 4 Drawing Sheets

ELECTRO-SPRAY COATING HEAD APPLICATOR

BACKGROUND OF THE INVENTION

1. Technical Field

This invention relates to material atomizers, specifically to improved spray head for dispensing coating materials used in electrostatic painting.

2. Description of Prior Art

Prior art rotating heads for atomizing and dispensing paint in the electrostatic power painting industry have relied on a variety of head and nozzle configurations. See for example U.S. Pat. Nos. 5,326,598, 5,353,995, 5,368,237, 5,632,448, 5,865,380 and 5,922,131.

U.S. Pat. No. 5,326,598 is directed to an electro-spray coating apparatus and process utilizing precise control of filament and misgeneration. The device applies voltage to the liquid forced to have a single continuous and substantially continuous radius or curvature around a shaping structure so as to produce a series of filaments which are spatially and temporarily fixed. The number of filaments being defined can be varied by adjustment of applied voltage with the filaments breaking into uniform mists of charged droplets and are driven towards the substrate by electric fields to produce a coating.

U.S. Pat. No. 5,353,995 claims a rotary ionizing head for electrostatic application of air powder mixtures on objects fused by heat. An ionizer head is rotated by a turbine having a deflector incorporated constituting a charging electrode.

U.S. Pat. No. 5,368,237 illustrates an improved spray nozzle for powder coating guns which has dual intersecting slot configurations so as under rotation to change the effective width of the coating being applied therethrough.

U.S. Pat. No. 5,632,448 shows a rotating power applicator for atomizing and dispensing powder utilizing a fluidized powered bed to entrain the powder fluidized in a bearing airstream and dispense same having a somewhat bell shaped interior.

U.S. Pat. No. 5,865,380 for a rotary atomizing electrostatic coating device having a plurality of discharge electrodes defining a band form pattern which extends outwardly along the rear side of the spray head's main body. A plurality of discharge electrodes rotate together with the spray head in the main body and charge current in the front side direction of the axis of rotation of the spray head is made uniform and increased by enhancing the painting efficiency.

Finally, in U.S. Pat. No. 5,922,131 an electrostatic power spray coating apparatus is disclosed with a rotary spray orifice of a slot configuration to impart a flat shape to an atomized material to be dispensed therethrough.

SUMMARY OF THE INVENTION

An improved rotary spray head to apply atomized fluid coating material in an electrostatic application process. The spray head has a plurality of annularly spaced dispensing openings of elongated equilateral longitudinal dimension, each defining an independent spray pattern in overlapping relation to one another imparted onto a dispersion disk surface with an improved material flow impingement area therewithin.

DETAILED DESCRIPTION OF THE INVENTION

Figure 1:
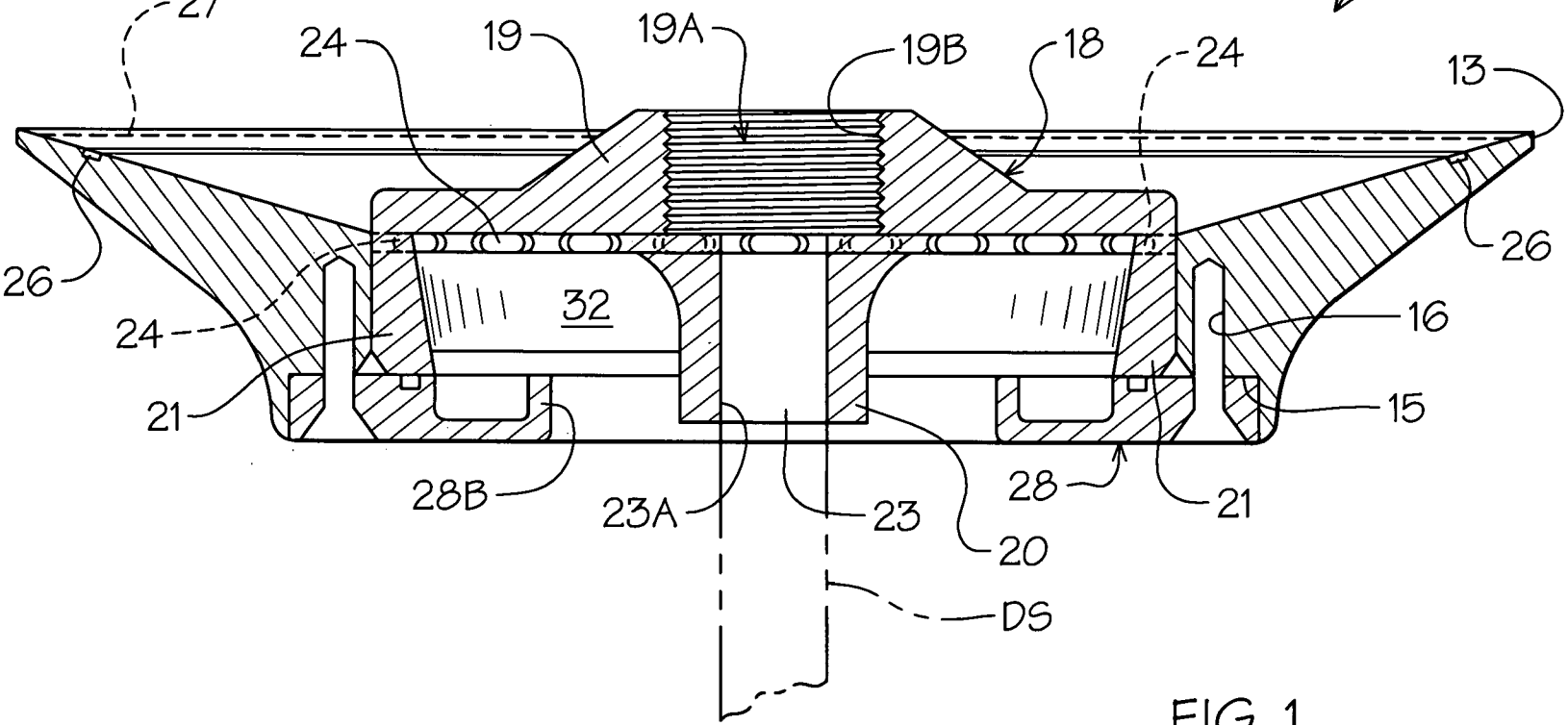
FIG. 1 is a section on lines 1-1 of FIG. 5.
Figure 2:
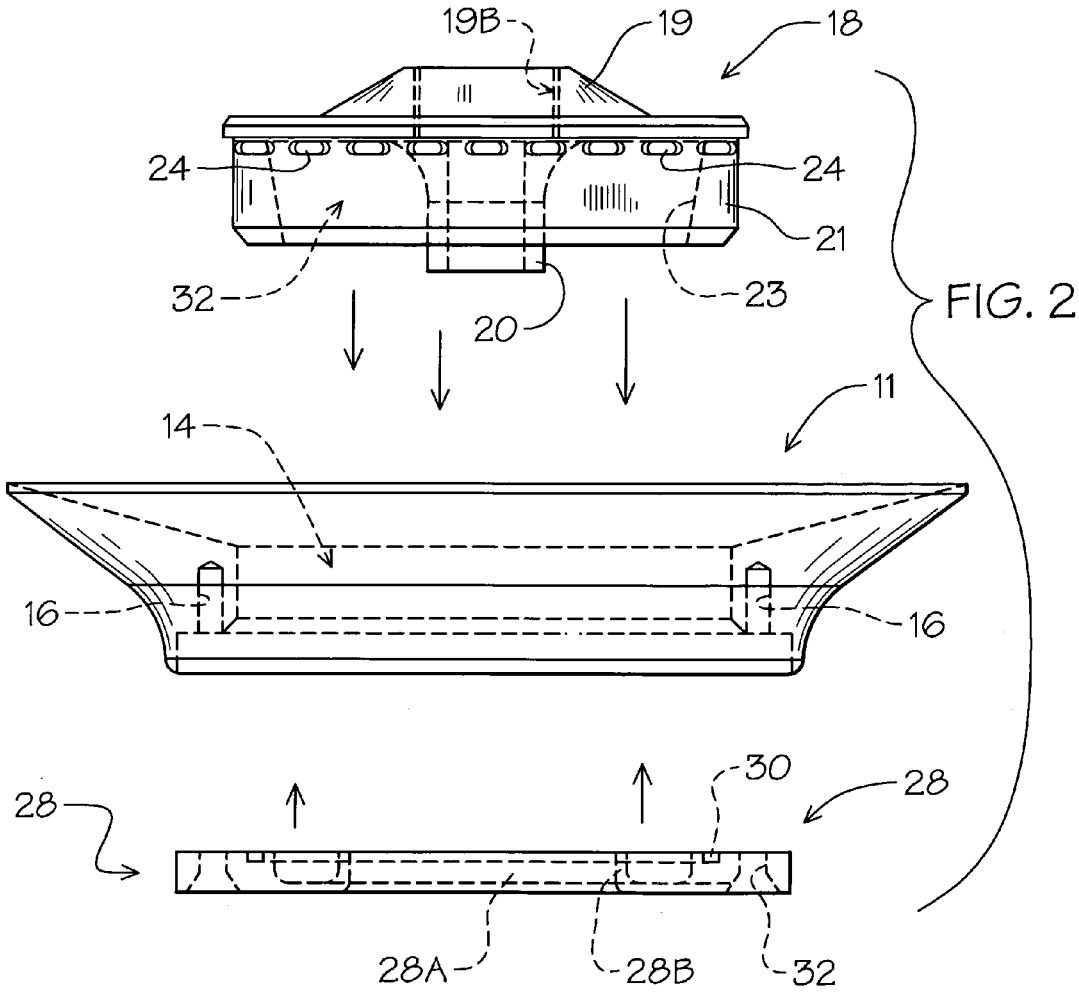
FIG. 2 is a side elevational exploded assembly view of the spray head of the invention.
Figure 3:
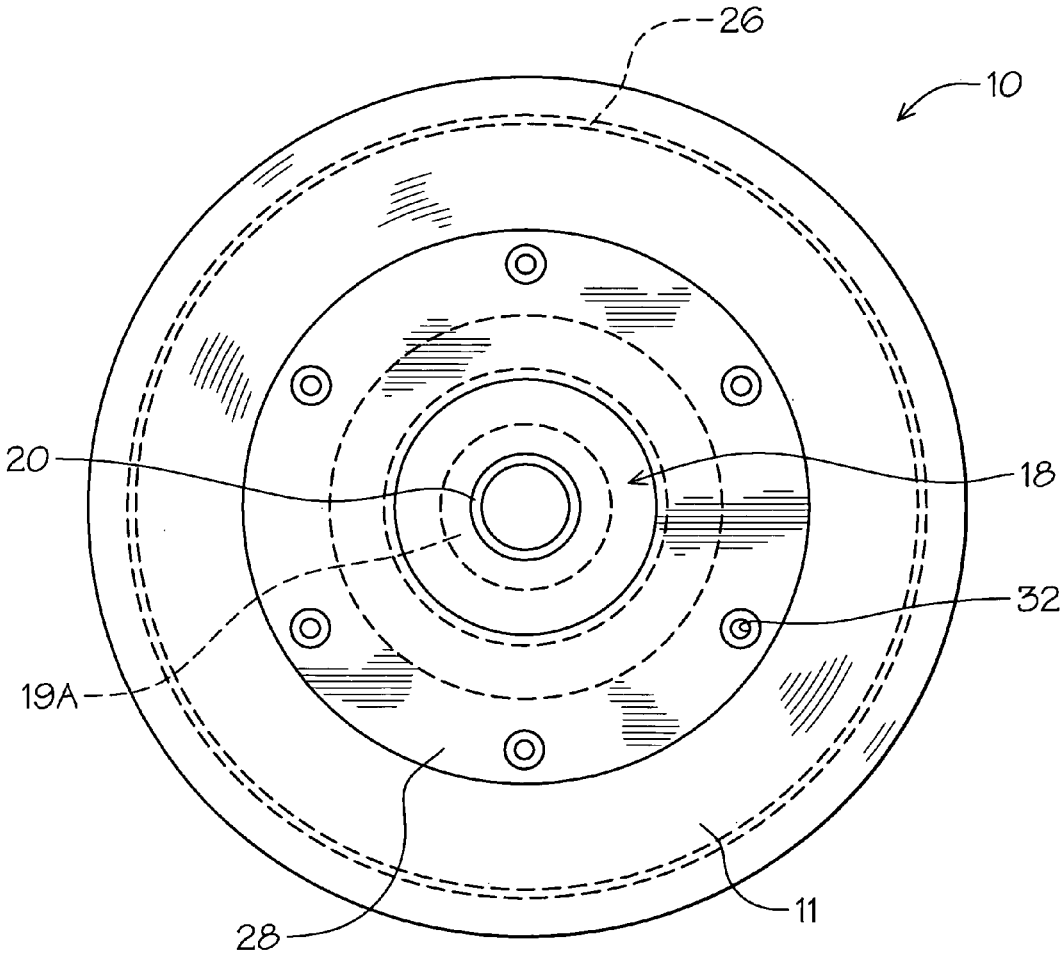
FIG. 3 is a bottom plan view of the assembly.

Referring to FIGS. 1 and 2 of the drawings, a rotary spray head assembly 10 can be seen used for the application of material coating fluids in an electrostatic painting system. The spray head assembly 10 has a main support drive and distribution body member 11 with a bowl shaped deflector top surface 12 terminating at a sharp tapered edge 13 thereabout. The body member 11 has a central annular receiving opening at 14 therein with an annular recess cap flange 15 formed in its oppositely disposed surface with a plurality of threaded bores 16 positioned therewithin define mounting surface 17 thereabout to receive corresponding threaded fasteners F as will be described in greater detail hereinafter.

Figure 4:
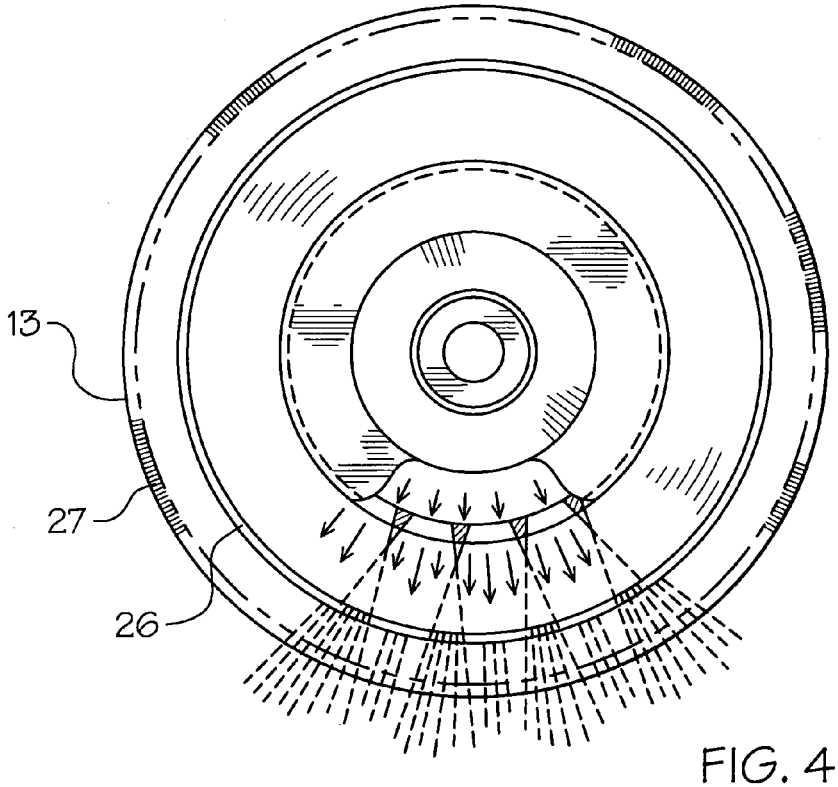
FIG. 4 is a top plan view of the assembly with portions broken away and material spray patterns depicted graphically thereon.

An annular material dispersing head 18, also seen in FIG. 4 of the drawings, has an apertured conical center portion 19 with an extending mounting hub portion 20 aligned therewith. A tapered depending annular flange wall 21 extends inwardly from a contoured perimeter edge 22, best seen in FIG. 1 of the drawings.

The hub portion 20 defines a center mount shaft receiving opening 23 therewithin having a tapered interior surface at 23A. The receiving opening 21 is in axial alignment with the aperture at 19A in the conical center portion 19 which is of a proportionally increased diameter and is internally threaded at 19B as will be well understood by those skilled in the art.

Figure 5:
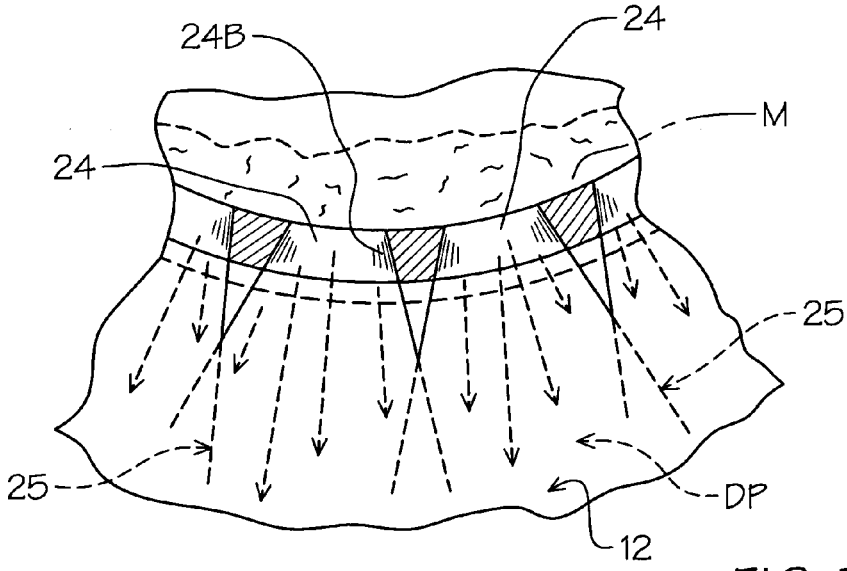
FIG. 5 is an enlarged top plan view with portions broken away of the spray head aperture dispensing configurations.

A plurality of radially spaced elongated material ejection dispersal openings 24 are formed within the depending annular flange wall 21. Each of the ejection dispersal openings 24, as best seen in FIGS. 4 and 5 of the drawings, is of an elongated slot-like configuration with oppositely opposing angularly disposed sidewalls 24A and 24B. The angular inclination of the respective sidewalls 24A and 24B indicated by the broken extension lines 25 in FIG. 6 of the drawings provide in combination with the proportional length to the height ratio of approximately two and a half to one are critical to the dispersion pattern DP imparted during operation in which the spray head is spun at relatively high revolutions per minute to afford the significant centrifugal force required to propel the material out through the respective ejection dispersal openings 24 as graphically illustrated in FIGS. 4 and 5 of the drawings. The material dispersal head 18 can be seen as assembled within the annular opening 14 of the body member 11 with a portion cut-away illustrated therefore graphically the radial pattern of the static dispersal spray pattern at DP shown in broken lines radiating outward from each of the spaced adjacent ejection dispersal openings 24.

FIG. 6 of the drawings is an enlarged portion of the spray head 18 broken away to illustrate the angular orientation of the walls 24A and 24B, of each apertured spray opening 24 and their respective contoured end wall curvilinear surfaces also seen in FIGS. 1 and 2 of the drawings.

The deflector top surface 12 has an annular groove 26 therewithin, spaced approximately one-quarter the distance inwardly of the surface 12 at from the tapered edge 13. The groove 26 is positioned so as to blend the respective multiple cross spray patterns DP of material as they emanate outwardly across the top surface 12 as hereinbefore described.

Once the ejected material impinges the groove 26, a continuous even sheeting action is achieved on the remainder of the surface 12 thereafter and is then released from the tapered edge 13 of the surface disk by a "sheer treatment" at 27 consisting of an annularly ribbed surface well known and used within the art.

It will be evident that given the rotation of the spray head assembly 10, the actual material pattern DP as depicted are implicitly curved during operation as they are produced (not shown).

Referring back to FIGS. 1 and 2 of the drawings, an assembly disk cap 28 can be seen having a central opening at 28A with a collar flange 28B thereabout. A corresponding annularly recessed area 29 extends therefrom as best seen in FIG. 4 of the drawings. A continuous gasket receiving channel 30 is formed inwardly from the perimeter edge thereof defining a mounting surface engagement at 31 with a plurality of annularly spaced fastener receiving apertures 32 therewithin that align with the hereinafter described threaded bores 16.

As to the assembly of the spray head 10 as illustrated in exploded assembly view in FIG. 2 of the drawings, the dispersal head 18 as hereinbefore described is thermally press fitted within the body member 11's receiving opening so that the corresponding ejection dispersal openings 24 are exposed against the top deflector surface 12. The assembled cap disk 28 is fitted within the mounting cap recess against the cap mounting surface 31 as hereinbefore described. The assembled cap disk 28 so fitted defines a material receiving chamber 32 about the corresponding hub into which coating material M is supplied during functional rotation of the spray head assembly 10 and is forced out through the ejection dispersal openings 24 by centrifugal force, as noted.

It will be seen that applicant's rotary spray head assembly 10 where the application of material coating fluid in an electrostatic painting system provides the unique combination of enhanced material dispersal patterns DP which provide selective interference therebetween onto the dispersal disk surface 12 having the unique impingement groove 26 therein so as to provide a homogenous sheeting pattern of coating material enhancing the effectiveness thereof and imparting additional benefit by reduced product material M usage afforded by improved product material cleaning proficiency within the head.

It will thus be seen that a unique and novel rotary spray head assembly has been illustrated and described and it will be evident to those skilled in the art that various changes and modifications may be made thereto without departing from the spirit of the invention.

Therefore I claim:

1. A rotary material spray head assembly for dispensing fluid coating materials comprising, a main support and drive engagement body member, an annular spray head within a central area of said body member, a plurality of elongated material ejection dispersal openings annularly positioned in an annular tapered flange wall of said spray head, said ejection dispersal openings having spaced opposing sidewalls in angular orientation to one another defining a tapered opening through said annular flange wall, spaced co-planar interior surfaces extending between said sidewalls, said sidewalls having curvilinear surfaces extending between said co-planar interior surfaces, a deflector surface in said body member extending in a continuous plane from said ejection dispersal openings, an annular material flow impingement groove in said deflector surface in spaced relation to said ejection dispersal openings, said impingement groove in co-planar alignment with said deflector surface.

2. The rotary material spray head assembly set forth in claim 1 wherein each of said elongated material dispersing openings has a longitudinal length greater than its proportional height.

3. The rotary material spray head assembly set forth in claim 1 wherein said material ejection disposal openings are of a longitudinal dimension two and half times that of their respective effective vertical opening dimension.

4. The rotary material spray head assembly set forth in claim 1, a material receiving chamber is formed within said main support and drive engagement body member and a cap disk selectively secured to said body member in oppositely disposed relation to a dispersal head top surface.

* * * * *